United States Patent [19]

Luch et al.

[11] 4,158,612

[45] Jun. 19, 1979

[54] POLYMERIC MANDREL FOR ELECTROFORMING AND METHOD OF ELECTROFORMING

[75] Inventors: Daniel Luch, Warwick, N.Y.; John E. Chart, Edinboro, Pa.

[73] Assignee: The International Nickel Company, Inc., Suffern, N.Y.

[21] Appl. No.: 864,274

[22] Filed: Dec. 27, 1977

[51] Int. Cl.[2] ..... C25C 7/02; C25D 17/12

[52] U.S. Cl. ..... 204/12; 204/281

[58] Field of Search ..... 204/12, 281, 290 R

[56] References Cited

U.S. PATENT DOCUMENTS

| | | | |
|---|---|---|---|
| 3,397,125 | 8/1968 | Tapley | 204/12 |
| 3,558,290 | 1/1971 | Baier et al. | 29/195 |
| 3,577,330 | 5/1971 | Knapp | 204/112 |
| 3,668,081 | 6/1972 | Borner | 204/12 |
| 3,847,649 | 11/1974 | Sova | 117/47 A |
| 3,865,699 | 2/1975 | Luch | 204/20 |
| 4,040,937 | 8/1977 | Iijima | 204/281 |

*Primary Examiner*—T. M. Tufariello

*Attorney, Agent, or Firm*—Francis J. Mulligan, Jr.; E. C. MacQueen

[57] ABSTRACT

An electroforming mandrel providing exceptional resistance to mask removal in highly corrosive electrolytes. The mandrel relies on a molecular bond between a non-conductive polymer mask and the electrically conductive polymer plating surface to avoid separation of these members and to allow multiple reuse. A metal core acts as a structural member and serves to uniformly distribute current to the electrically conductive polymer.

6 Claims, 1 Drawing Figure

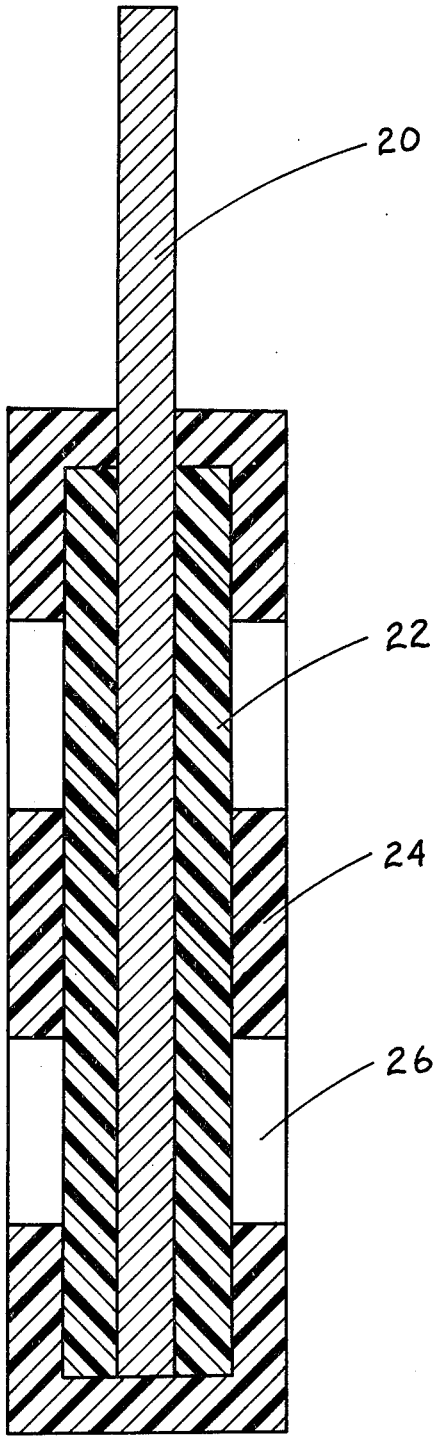
20
22
24
26

POLYMERIC MANDREL FOR ELECTROFORMING AND METHOD OF ELECTROFORMING

The present invention relates to a mandrel, and to the method of using the mandrel, for electrolytically depositing metals in sub-divided form for use as electroplating stock or as electroforms.

BACKGROUND OF THE INVENTION

In the process of electrorefining, it is highly desirable to deposit metals in the form of small individual pieces rather than as large cathodes, since smaller pieces can be more readily charged into melting furnaces or electroplating baskets. When, in conventional refining processes, elemental metals are produced as large cathodes, e.g., 70×90 centimeters, it is generally advantageous and in many cases necessary to divide these large cathodes into smaller pieces, e.g., 5×5 cm. Large cathodes are generally reduced in size by shearing; however, this operation entails considerable labor expense and wear of the shear blade necessitates frequent replacement.

In order to overcome the necessity for a shearing operation, several methods have been devised for producing cathodes in the form of small pieces. For example, in the production of nickel as described in U.S. Pat. No. 3,577,330, a permanent cathode mandrel, or workpiece, was designed which contains conductive islands on its surfaces. The conductive islands are defined by means of interconnecting areas of non-conductive materials such as paint, varnish, lacquer and tape. U.S. Pat. No. 3,668,081 is concerned with a more advanced mandrel made of chromium plated stainless steel masked with a thermosetting epoxy ink or paint that is silk-screen-printed upon the surface to provide the desired masking.

The aforedescribed mandrels are currently in use for the production of electrolytic nickel. For refining this metal as well as cobalt and iron, the mandrels work effectively and may be used several times without requiring refurbishing. However, in the process of refining a metal such as copper, the electrolyte is considerably more corrosive than that used for plating of nickel, cobalt and iron. As a consequence, the aforedescribed mandrels have been found to have limited life in copper refining electrolytes due to deterioration of the adhesive bond at the junction of metal and coating. Such deterioration is believed to be associated with difference in coefficients of thermal expansion, corrosive attack of the metal mandrel, abrasion during use and dissolution and/or hydrolyzation of the masking substance. Deterioration can occur during a single use in a copper electrolyte and results in the formation of undesirably large and irregularly shaped cathode pieces unsuitable for the marketplace. Also, when repair of the epoxy layer of a prior art mandrel is required, the application of heat can cause undesirable overaging and brittleness in the epoxy layer immediately adjacent to the repair.

Similarly in electroforming, or fabrication of articles by electrodeposition, a need exists for a mandrel that will be readily separable from the electrodeposit and will resist tearing and penetration of the electrolyte between the conductive and non-conductive portions of the mandrel. Furthermore, it is highly desirable that the mask itself resist tearing during removal of the electroform so that the mandrel can be used many times. In addition, the availability of a conductive flexible polymeric mandrel would be of great advantage in the art to circumvent the necessity for coating a non-conductive workpiece with a conductive substance, e.g., graphite, silver, etc., prior to plating.

SUMMARY OF THE INVENTION

It has now been discovered that deterioration during electroplating can be substantially reduced with a mandrel having a non-conductive polymer mask molecularly bonded to a conductive polymer plating surface. Generally speaking, the present invention is directed to a mandrel for electroforming and to the process of using the mandrel. The mandrel for electroforming metal comprises: a metal core, at least one electrically conductive polymer layer resistant to an electroplating electrolyte in contact with and enclosing at least a portion of the metal core, and at least one non-conductive polymer layer resistant to an electroplating electrolyte and molecularly bonded to the electrically conductive polymer layer and surrounding the electrically conductive polymer layer and the metal core, the non-conductive polymer layer having a pattern of open areas corresponding to the size and shape of a desired cathode product such that the open areas expose a pattern of conductive areas on the electrically conductive polymer layer. During use the mandrel is immersed in a metal electrolyte as cathode. The desired cathode product is electrodeposited upon the open areas of the electrically conductive polymer. Following electrodeposition, the mandrel and the desired cathode product are removed form the electrolyte and the cathode product stripped from the mandrel.

BRIEF DESCRIPTION OF THE DRAWING

The FIGURE represents a cross-sectional view of a preferred embodiment of a polymer mandrel.

DETAILED DESCRIPTION OF THE INVENTION

The drawing shows a mandrel having a metal core 20 which serves to uniformly distribute electrical current and in addition provides desirable structural properties. During operation, the extended portion of the metal core is electrically connected to a bus bar (not shown). An electrically conductive polymer layer 22 is mechanically bonded to the metal core, present on both sides of the metal core in the drawing, and serves as a surface for electrodeposition. Portions of the electrically conductive polymer layer are masked by a non-conductive polymer layer 24 so that during plating, electrodeposits having a particular desired shape can be formed upon open areas 26 on the conductive polymer layer.

The metal used in the mandrel can be of any available form of solid or perforated sheet metal or wire mesh or expanded metal suitably treated to afford adhesion to the polymer. The metal used should be chosen to provide suitable strength, conductivity, flexibility and preferably corrosion resistance compatible to that of the electrolyte in the event that it becomes exposed to the electrolyte by splashing or direct and prolonged contact with the electrolyte in the absence of current flow. Because the metal core is intended to provide substantially uniform current distribution over the surface of the mandrel, the metal selected should have good conductivity so that excessive heating doses not occur inside the mandrel or at bus bar connections. The metal core can be a foil, e.g., 0.02 mm thick or even a sheet or plate, e.g., 6 mm thick. The metal should be prepared to possess bonding characteristics favorable to the conductive polymer used in the mandrel. It should be free from oxides and grease. Preferably, the surface of the metal should be roughened by a well known technique such as sandblasting, shot blasting, machining, grinding, etc., to promote adherence of the polymeric layer and to increase electrical conductivity.

Metals which may be used as the metal core include steel, copper, nickel, cobalt, stainless steels, nickel-base alloys, and other materials, e.g., steel, electroplated with corrosion-resistant metals. For example, in the process of electrorefining copper, it is preferred to use a copper core.

As will be recognized by those skilled in the art, the polymeric materials employed in the electrically conductive and the non-conductive layes of the mandrel are preferably chosen from those having good acid resistance, low water absorbency, at least moderate flexibility, useful strength, favorable metal bonding characteristics, preferably low permeability to gases such as hydrogen, resistance to temperatures up to about 100° C., and capability for blending with an electrically conductive substance. Many thermoplastics and even some thermosetting resins are contemplated to be suitable for the purpose of the present invention. By way of illustration, these materials include: rigid polymers (e.g., polyethylene, polypropylene polyvinyl chloride, polymethyl methacrylate, fluroplastics, ionomers, acrylonitrile butadiene styrene), copolymers (e.g., ethylene-propylene, vinylchloride-acetate, vinylidene chloride-vinylchloride), compounded materials (e.g., polyvinyl chloride plus acrylonitrile butadiene styrene), some elastomers (e.g., ethylene-propylene rubber), and epoxide resins (e.g., diglycidyl ether of bisphenol A (epoxy resin) with dicyandiamide hardener). The thickness of the conductive and non-conductive layers can be from about 0.02 mm to about 6 mm or even about 12 mm.

Additives used to enhance specific properties include: well known anti-oxidants such as dilaurylthiodipropionate and others such as those shown starting on page 654 of the October 1976 issue of Modern Plastics Encyclopedia in amounts up to about 5%; plasticizers such as di-octyl phthalate and others such as those shown starting on page 688 of the aforecited reference in amounts up to about 10%; and heat stabilizers such as that sold under the trade designation Thermolite 25, available from M&T Chemicals, Inc. and others such as those shown starting on page 698 of the aforecited reference in amounts up to about 20%. Also, various solvents or combination of solvents can be used advantageously during processing of the electrically conductive and non-conductive polymer layers.

It is advantageous to use the same basic materials in both the electrically conductive and non-conductive layers to insure a high degree of bonding which will serve to prevent delamination in service. If combinations of polymers are selected which do not have suitable bonding characteristics in a temperature/pressure bonding process, the use of a suitable adhesive is contemplated for joining the conductive and non-conductive layers. The adhesive should be selected to provide a molecular bond between the layers (i.e., have at least some capatibility with both layers).

The conductive polymer layer can be produced by blending (e.g., by milling) a mixture of an electrically conductive substance (e.g., a conductive carbon black) and a suitable polymer (e.g., low density polyethylene) to uniformly disperse the conductive substance throughout the polymer in electrically conductive relation. Conductive carbon blacks such as that prepared from acetylene and sold by Shawinigan Products Corporation under the trade designation Acetylene Carbon Black and that produced by Cabot Corporation and sold under the trade designation Vulcan XC72 are suitable for blending with the polymers. Carbon black is generally added in amounts of from about 10% to about 50% by weight. The conductivity of the polymer layer is poor with less than about 10% carbon. The volume resistivity of the conductive polymer layer should be less than about 100 ohm-centimeters and most advantageously less than about 10 ohm-centimeters. With more than about 50% carbon, the material has insufficient flexibility and is prone to cracking. Following blending, the compounded stock is fabricated into sheet form using conventional techniques. For polyethylene, it has been found expedient to use a compression mold at temperatures of about 120° C. to about 210° C., at pressures of about 0.35 $Kg/mm^2$ to about 17.6 $Kg/mm^2$, and for time periods of about one to about ten minutes.

The surface of the electrically conductive polymer layer that contacts the electrodeposited metal can be roughened by sandblasting or shaped by mechanical means by forming a pattern thereon to aid in mechanically holding the electrodeposited metal. Also, it is contemplated that a leachable second phase, e.g., a metal powder, can be contained within the polymer. When the completed mandrel is exposed to an acid, the second phase is dissolved providing surface recesses which aid in mechanically holding the electrodeposit on the mandrel. The leachable second phase should have a particle size in the range of about −100 to about −325 U.S. standard sieve size, so that holes of appropriate size are present in the surface of the conductive polymer layer to assist retention of the deposited metal thereon.

The non-conductive layer can be prepared from a polymer, such as low density polyethylene, preferably of the same composition as that used for preparing the conductive portion of the mandrel. This material is formed into sheets having holes or patterns with shape and size corresponding to the desired shape and size of the metal cathode pieces to be deposited. The holes or patterns should be suitably spaced so that during growth of the deposit there is no undesired interconnection of the growing cathode pieces particularly in heavy section thickness electrodeposits.

Because the non-conductive polymer layer is of finite thickness, it will aid in the retention of the electrodeposited metal to the mandrel. Also, the edges of the open areas in the non-conductive polymeric sheets can be formed to have a re-entrant angle which will aid in holding the growing cathode pieces or patterns in place. Since the non-conductive polymer layer is relatively flexible, the electroformed pieces can be easily removed by flexing.

The metal core, conductive and non-conductive polymer layers are preferably joined together by the application of heat and pressure. It is essential that a molecular bond is obtained between the polymer layers. In the preferred condition, the metal core is perforated so that the layers of conductive polymer, bond to each other through the perforations thereby firmly bonding in place and surrounding the sheet metal core to form a unitary structure. Heating to temperatures of about 120° C. to about 210° C. for time periods of about one to about ten minutes at pressures of about 0.35 $Kg/mm^2$ to about 15 Kg/mm$^2$ have been found effective for the preparation of mandrels. The conditions used for bonding should be selected so that smearing or other undesirable deformation of the holes is avoided, e.g., by application of excessive pressure.

In addition to the aforedescribed method of preparing the mandrel, it is also contemplated that the non-conductive polymer may be applied over the conductive polymers and/or metal core in a fluidized form by a process such as silk-screening, printing, painting or powder spraying. In this method, the polymer can be dispersed or dissolved in a suitable liquid and following application, fused or diffused in place. This method of preparing a mandrel is advantageous where relatively small and thin deposits, e.g., sheet metal electroforms, are desired since the adherent support provided by a thicker non-conductive layer will not be present. Although other non-conductive coating materials, e.g., epoxies, paints, wax, etc., might be used in place of the non-conductive polymer layer, it is essential to use a polymeric substance for this layer that will form a molecular bond with the electrically conductive polymer layer. The resultant molecularly-bonded interface is advantageously resistant to penetration by the electrolyte and the electrodeposit. Such penetration is generally considered responsible for deterioration of prior art mandrels. Similarly, where an adhesive is used to join the conductive and nonconductive layers, the adhesive selected should be characterized by the ability to form a molecular bond between the electrically conductive and non-conductive layers as well as have the other requisite properties of: resistance to dissolution in the electrolyte, capability for use at the operating temperature of the plating bath, low water absorbency, flexibility, strength, etc.

Following electrodeposition, the electrodeposited metal can be readily removed from the mandrel. Due to the difference in the coefficients of expansion of metal and polymer, cooling from the plating temperature, e.g., 50° C., to room temperature, causes substantial release of the electrodeposit from the mandrel surface. Sharp blows with a hammer and/or flexing of the mandrel can be used to complete the release of the electrodeposits. The mandrel should be examined for defects following removal of the electrodeposit and, if free from defects, returned to the electroforming circuit. Where repair is required, this can be easily accomplished with polymeric substances (e.g., low density polyethylene) by the heat-fusion of patches of the corresponding conductive and non-conductive polymeric substances in appropriate locations.

For the purpose of giving those skilled in the art a better understanding of the invention, the following illustrative examples are given.

EXAMPLE I

This example illustrates the usefulness of the process of this invention for copper electrorefining. It demonstrates the reusability of the mandrel and its resistance to deterioration.

A 0.16 cm×12.7 cm×12.7 cm mandrel was prepared for copper electrorefining using a central core of expanded pure nickel, two sheets of electrically conductive polymer and two sheets of non-conductive polymer.

The central core was prepared from nickel sheet that had a 0.013 centimeter strand thickness, a 0.013 centimeter strand width and a 4/0 mesh pattern.

The electrically conductive polymer layers were prepared by blending and pressing. A mixture of 15 grams of conductive carbon black (Cabot Corporation's Vulcan XC72), 35 grams of low density polyethylene and 0.375 gram of antioxidants were milled at 177° C. in an internal polymer mill, known as a Brabender mill, operating at a speed of 20 rpm. The mixture was milled until visually uniform for a time period of about 5 minutes. The mixture was subsequently subjected to a pressure of 14 Kg/mm$^2$ for 5 minutes at 188° C. in a press to provide a sheet of electrically conductive polymer measuring 0.16 cm×12.7 cm×12.7 cm. Although the electrical resistivity of the specific pressed mixture was not measured, typically an electrical resistivity of about 10 ohm cm is attained.

A charge consisting of 55 grams of low density polyethylene and 0.5 gram of antioxidant was milled for 5 minutes at 177° C. Two 0.16 cm×12.7 cm×12.7 cm sheets were molded using the conditions described previously for the electrically conductive polymeric sheets. 12 mm diameter holes were punched in the non-conductive polymeric sheets spaced about 6 mm apart so that during growth of copper cathodes, overlapping would not occur between the individual copper cathode.

Sheets of electrically conductive polymer were placed on either side of the expanded nickel sheet and fused to the expanded nickel sheet by heating the sandwiched components in a press. The temperature in the press was 177° C. and the pressure applied was 14 Kg/mm$^2$ for a time period of 3 minutes. This structure was removed from the press and non-conductive polymr sheets containing the aforedescribed hole pattern were placed on either side. The assembly was reintroduced to the press where it was heated to 177° C., at a pressure of 1.4 Kg/mm$^2$ for about 1.5 minutes. Polyethylene sheet was placed around the edge of the assembly and heat sealed in place to complete the mandrel.

The mandrel was placed in a copper refinery electrolyte containing 61.5 gpl copper, 6 gpl nickel, 5 gpl iron, 1.5 gpl cobalt, 1.7 gpl arsenic, 146 gpl sulfuric acid, 0.01 gpl chloride and less than 10 ppm of chromium. The bath was maintained at 45° C. The voltage was about 2.2 volts and the current density was 215 amperes per square meter, based on the open area of the punched holes. The mandrel was removed from the electrolyte after 168 hours and the crop of copper buttons was stripped from the surface of the mandrel by light hammer blows. The number of buttons prepared with this mandrel was 56 and the average weight of each copper button was about 7 grams.

The electrorefining procedure was repeated 5 times. The buttons were readily removed from the surface of the workpiece and had a uniform shape and size. The mandrel incurred no apparent damage and exhibited no substantial deterioration during the electrorefining operation or the removal procedure.

EXAMPLE II

A 0.29 cm×12.7 cm×12.7 cm mandrel was prepared for copper electrorefining which had a copper central core, two sheets of electrically conductive polymer and two sheets of 0.01 cm thick non-conductive polymer film.

The central core was prepared from copper sheet that had a thickness of 0.076 mm. 0.24 cm diameter holes were punched in the copper sheet with center-to-center spaces of about 1.3 cm.

The electrically conductive polymer was prepared in an internal polymer mill. A mixture of 16 grams of conductive carbon black and 32 grams of low density polyethylene were milled at 177° C. for 9 minutes at a rotor speed of 20 rpm. The mixture was then compression molded to provide sheets of electrically conductive polymer measuring 0.16 cm×12.7 cm×12.7 cm. Molding was accomplished by pressing for 3 minutes at 7 Kg/mm$^2$ pressure and 188° C.

The non-conductive commercially produced polyethylene overlays were prepared by cutting holes of varying geometry in the 0.1 mm thick film. Hole shapes were circular, triangular and square.

Sheets of electrically conductive polymer were placed on either side of the copper sheet and fused to each other and to the coper sheet by heating the sandwich in a press. The temperature of the press was 177° C. and the pressure applied was 14 Kg/mm$^2$ for about 3 minutes. This assembly was removed from the press and the aforedescribed non-conductive polymer sheets were placed on each side. The assembly was reintroduced to the press where it was heated to 177° C. at a pressure of 3.5 Kg/mm$^2$ for about 1.5 minutes. Polyethylene sheet was placed around the edges of the assembly and heat sealed in place to complete the mandrel. Various patterns were scribed upon the conductive surfaces to provide additional keying of the particulate metal electroforms.

The mandrel was placed in a copper electrorefining bath having the composition described previously in Example I. A current density of about 215 amperes/M$^2$ (based on the open area of the holes in the non-conductive layers) was applied to the mandrel. The mandrel was removed from the electrolyte after about 168 hours and the crop of particulate copper electroforms was stripped from the surface of the mandrel by relatively light hammer blows to its surface.

As in Example I, the electrorefining procedure was repeated 5 times. The mandrel incurred no apparent damage during the electrorefining operation or the removal procedure.

EXAMPLE III

A thin sheet electroform was prepared on a workpiece having areas formed from non-conductive polymer applied as a paint upon a conductive polymer surface.

A 0.08 mm thick×2"wide×3"long copper sheet was used as the central core of the workpiece. The copper sheet was perforated with 2.5 mm diameter holes spaced about 13 mm apart.

The electrically conductive polymer layers were prepared from a mixture of 23.5 grams of polyvinyl chloride, 9 grams of polyisobutylene (Vistanex L-100 supplied by Exxon Corp.), 3 grams of the plasticizer di-octyl phthalate, 7 grams of a heat stabilizer (Thermolite T-25 supplied by M&T Chemicals Corp.) and 18 grams of conductive carbon black (Vulcan XC-72 supplied by Cabot Corp.). The mixture was blended in an internal polymer mill at 177° C. for 9 minutes at a rotor speed of 20 rpm. The mixture was compression molded to provide sheets of electrically conductive polymer measuring 0.16 cm by 5 cm by 7.6 cm by pressing at 7 Kg/mm$^2$ for 3 minutes at 177° C.

The electrically conductive polymer layers were placed on either side of the perforated copper sheet. The sandwiched assembly was placed in a press at 177° C. at a pressure of 14 Kg/mm$^2$ for about 3 minutes.

The non-conductive polymer mixture consisting of 20 grams of polyvinyl chloride and 5 grams of di-octyl pthalate were dissolved in a solvent consisting of 130 grams of methyl ethyl ketone, 20 grams of tetrahydrafuran and 50 grams of xylene. Drops of this viscous, non-conductive polymer mixture were placed upon the surface of the conductive mandrel in simulation of a silk screening operation. The drops were about 13 mm in diameter and were spaced about 13 mm apart. The mandrel was dried at 85° C. for 2 hours resulting in bonding of the non-conductive polymer to the conductive polymer layer by diffision.

The mandrel was placed in a standard Watts nickel bath at a calculated current density of 20 amperes/m$^2$. After about 45 minutes, the workpiece was removed from the nickel bath and the foil readily stripped from the workpiece. The stripped foil was about 0.05 mm thick and had a hole-pattern corresponding to the pattern imposed by the presence of the non-conductive circular areas. The edges of the holes were well defined.

The plating procedure was repeated on this mandrel a second time using the same conditions. The second electroform was readily removed from the mandrel and was uniform in quality and thickness. The mandrel did not deteriorate as a result of this use.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

We claim:

1. A mandrel for electroforming metal comprising:

a. a thin metal core having a laminar configuration with an extended surface area;

b. at least one electrically conductive polymer layer resistant to an electroplating electrolyte in contact with and enclosing at least a portion of said metal core; and c. at least one non-conductive polymer layer resistant to an electroplating electrolyte molecularly bonded across said extended surface area to said electrically conductive polymer layer and surrounding said electrically conductive polymer layer and said metal core, said non-conductive polymer layer having a pattern of a multiplicity of open areas corresponding to the size and shape of a desired cathode product such that the said open areas expose a pattern of conductive areas on said electrically conductive polymer layer.

2. A mandrel as defined in claim 1 wherein said electrically conductive polymer layer is prepared from a mixture containing, in weight percent, from about 10% to about 50% conductive carbon black in an amount sufficient to provide an electrical resistivity of less than about 100 ohm-centimeters, up to about 20% heat stabilizer, up to about 10% plasticizer, up to about 5% antioxidants, and the balance a polymer.

3. A mandrel as defined in claim 2 wherein said electrically conductive polymer layer is prepared from a polymer selected from a group consisting of polyvinyl chloride, polyethylene, and polypropylene.

4. A mandrel as defined in claim 3 wherein said non-conductive polymer layer is prepared from a mixture containing, in weight percent, up to about 20% heat stabilizer, up to about 10% plasticizer, up to about 5% anti-oxidants, and the balance a polymer sealable to said electrically conductive polymer layer.

5. A mandrel as defined in claim 4 wherein said non-conductive polymer layer is prepared from a polymer selected from a group consisting of polyvinyl chloride, polyethylene, and polypropylene.

6. A method for electroforming metal comprising:

a. immersing in a metal electrolyte as cathode, a mandrel having a laminar metal core of extended surface area with at least one electrically conductive polymer layer resistant to an electroplating electrolyte in contact with and enclosing at least a portion of said metal core, and at least one non-conductive polymer layer resistant to an electroplating electrolyte molecularly bonded across said extended surface area to said electrically conductive polymer layer and surrounding said electrically conductive polymer layer and said metal core, said non-conductive polymer layer having a pattern of a multiplicity of open areas corresponding to the size and shape of a desired cathode product such that the said open areas expose a pattern of conductive areas on said electrically conductive polymer layer; and b. electrodepositing said desired cathode product upon said open areas of said electrically conductive polymer and c. recovering a multiplicity of units of the cathode product having a size and shape conforming essentially to the size and shape of said open areas.

* * * * *